US006676483B1

(12) United States Patent
Roberts

(10) Patent No.: US 6,676,483 B1
(45) Date of Patent: Jan. 13, 2004

(54) ANTI-SCATTERING LAYER FOR POLISHING PAD WINDOWS

(75) Inventor: John V. H. Roberts, Newark, DE (US)

(73) Assignee: Rodel Holdings, Inc., Wilmington, DE (US)

( * ) Notice: Subject to any disclaimer, the term of this patent is extended or adjusted under 35 U.S.C. 154(b) by 0 days.

(21) Appl. No.: 10/357,024

(22) Filed: Feb. 3, 2003

(51) Int. Cl.[7] ..... B24B 49/00

(52) U.S. Cl. ..... 451/6; 451/10; 451/11; 451/285; 451/287

(58) Field of Search ..... 451/6, 9, 10, 11, 451/41, 54, 59, 63, 285, 287, 530, 533

(56) References Cited

U.S. PATENT DOCUMENTS

| | | | | |
|---|---|---|---|---|
| 5,964,643 | A | 10/1999 | Birang et al. | |
| 6,171,181 | B1 | 1/2001 | Roberts et al. | |
| 6,179,709 | B1 | 1/2001 | Redeker et al. | |
| 6,280,290 | B1 | 8/2001 | Birang et al. | |
| 6,454,630 | B1 | 9/2002 | Tolles | |
| 6,458,014 | B1 * | 10/2002 | Ihsikawa et al. | 451/6 |
| 6,524,164 | B1 | 2/2003 | Tolles | |
| 6,544,104 | B1 * | 4/2003 | Koike et al. | 451/9 |

FOREIGN PATENT DOCUMENTS

| | | | |
|---|---|---|---|
| EP | 1 306 163 | A1 | 5/2003 |
| JP | 2001-291686 | A | 10/2001 |
| JP | 2003-48151 | A | 2/2003 |
| WO | WO 01/23141 | A1 | 4/2001 |

* cited by examiner

*Primary Examiner*—Eileen P. Morgan
(74) *Attorney, Agent, or Firm*—Blake T. Biederman

(57) ABSTRACT

An anti-scattering layer for polishing pad windows as used in chemical-mechanical planarization (CMP) systems is disclosed. The invention finds particular use in circumstances where the windows have a roughened lower surface. The anti-scattering layer is formed over the roughened lower surface of the window in a manner that significantly reduces light scattering while making optical in-situ measurements of a wafer undergoing a CMP process. The reduced light scattering results in an increased signal strength, which makes for more robust optical in-situ measurement capability.

8 Claims, 1 Drawing Sheet

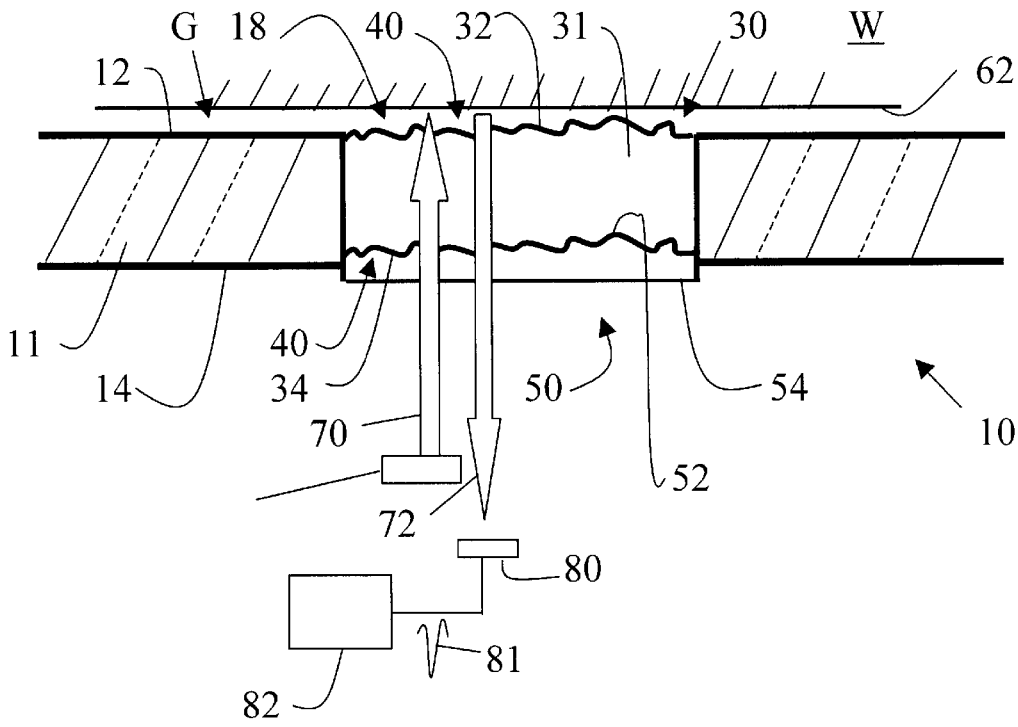
Figure

ANTI-SCATTERING LAYER FOR POLISHING PAD WINDOWS

FIELD OF THE INVENTION

The present invention relates to polishing pads used for chemical-mechanical planarization (CMP), and in particular relates to such pads that have windows formed therein for performing optical end-point detection.

BACKGROUND OF THE INVENTION

In the fabrication of integrated circuits and other electronic devices, multiple layers of conducting, semiconducting, and dielectric materials are deposited on or removed from a surface of a semiconductor wafer. Thin layers of conducting, semiconducting, and dielectric materials may be deposited by a number of deposition techniques. Common deposition techniques in modem processing include physical vapor deposition (PVD), also known as sputtering, chemical vapor deposition (CVD), plasmaenhanced chemical vapor deposition (PECVD), and electrochemical plating (ECP).

As layers of materials are sequentially deposited and removed, the uppermost surface of the substrate may become non-planar across its surface and require planarization. Planarizing a surface, or "polishing" a surface, is a process where material is removed from the surface of the wafer to form a generally even, planar surface. Planarization is useful in removing undesired surface topography and surface defects, such as rough surfaces, agglomerated materials, crystal lattice damage, scratches, and contaminated layers or materials. Planarization is also useful in forming features on a substrate by removing excess deposited material used to fill the features and to provide an even surface for subsequent levels of metallization and processing.

Chemical mechanical planarization, or chemical mechanical polishing (CMP), is a common technique used to planarize substrates such as semiconductor wafers. In conventional CMP, a wafer carrier or polishing head is mounted on a carrier assembly and positioned in contact with a polishing pad in a CMP apparatus. The carrier assembly provides a controllable pressure to the substrate urging the wafer against the polishing pad. The pad is optionally moved (e.g., rotated) relative to the substrate by an external driving force. Simultaneously therewith, a chemical composition ("slurry") or other fluid medium is flowed onto the substrate and between the wafer and the polishing pad. The wafer surface is thus polished by the chemical and mechanical action of the pad surface and slurry in a manner that selectively removes material from the substrate surface.

A problem encountered when planarizing a wafer is knowing when to terminate the process. To this end, a variety of planarization end-point detection schemes have been developed. One such scheme involves optical in-situ measurements of the wafer surface and is described in U.S. Pat. No. 5,964,643, which patent is incorporated herein by reference. The optical technique involves providing the polishing pad with a window transparent to select wavelengths of light. A light beam is directed through the window to the wafer surface, where it reflects and passes back through the window to a detector, e.g., an interferometer. Based on the return signal, properties of the wafer surface, e.g., the thickness of films (e.g., oxide layers) thereon, can be determined.

While many types of materials for polishing pad windows can be used, in practice the windows are typically made of the same material as the polishing pad, e.g., polyurethane. For example, U.S. Pat. No. 6,280,290 discloses a polishing pad having a window in the form of a polyurethane plug. The pad has an aperture and the window is held in the aperture with adhesives.

A problem with such windows arises when they have surface roughness. For example, polyurethane windows are typically formed by slicing a section from a polyurethane block. Unfortunately, the slicing process produces microgrooves on either side of the window. The depth of the microgrooves range from about 10 to about 100 microns. The microgrooves on the bottom surface scatter the light used to measure the wafer surface topography, thereby reducing the signal strength of the in-situ optical measurement system. The microgrooves on the upper surface do not tend to scatter light as much as the bottom surface microgrooves due to the presence of a liquid slurry and proximity of the upper surface to the wafer.

Because of the loss in signal strength from scattering by the lower window surface, the measurement resolution suffers, and measurement variability is a problem. Also, because other sources of signal loss arise during the polishing process, at some point the pad or the pad window needs to be replaced.

SUMMARY OF THE INVENTION

The present invention addresses the problem of light scattering in end-point detection systems used in CMP systems that employ a transparent window in the polishing pad.

One aspect of the invention is an apparatus comprising a polishing pad body having an aperture formed therein. A window is fixed in the aperture, the window having a lower surface with a surface roughness capable of scattering light 10% or more of the light incident thereon. An anti-scattering layer is formed over the lower surface of the window to reduce the scattering of light by the roughened lower surface.

Another aspect of the invention is a method of performing in-situ optical measurements of a wafer in a CMP system. The method includes providing the CMP system with a polishing pad having a window, the window having a roughened lower surface upon which is formed an anti-scattering layer, and directing a first beam of light through the anti-scattering layer and the window to the wafer. The method further includes reflecting the first beam of light from the wafer to form a second beam of light that passes back through the window and the anti-scattering layer. The method also includes detecting the second beam of light, converting the detected second beam of light to an electrical signal, and processing the electrical signal to deduce one or more properties of the wafer.

BRIEF DESCRIPTION OF THE DRAWINGS

The Figure is a close-up cross-sectional view of a CMP system showing a polishing pad having a window with the anti-scattering layer formed on the lower surface of the window, a wafer residing adjacent the upper surface of the polishing pad, and the basic elements of an in-situ optical detection system.

DETAILED DESCRIPTION OF THE INVENTION

In the following detailed description of the embodiments of the invention, reference is made to the accompanying drawings that form a part hereof, and in which is shown by way of illustration specific embodiments in which the invention may be practiced. These embodiments are described in sufficient detail to enable those skilled in the art to practice the invention, and it is to be understood that other embodiments may be utilized and that changes may be made without departing from the scope of the present invention. The following detailed description is, therefore, not to be taken in a limiting sense, and the scope of the present invention is defined only by the appended claims.

With reference to the Figure, there is shown a close-up cross-sectional view of a polishing pad 10. Polishing pad 10 has a body region 11 that includes an upper surface 12 and a lower surface 14. Polishing pad 10 may be any of the known polishing pads, such as urethane-impregnated felts, microporous urethane pads of the type sold under the tradename POLITEX by Rodel, Inc., of Newark Del., or filled and/or blown composite urethanes such as the IC-Series and MH-series pads, also manufactured by Rodel.

Polishing pad 10 also includes an aperture 18 in body 11 within which is fixed a window 30. In one example embodiment, window 30 is permanently fixed in the aperture, while in another example embodiment it is removably fixed in the aperture. Window 30 has a body region 31 that includes an upper surface 32 and a lower surface 34. Window 30 is transparent to wavelengths of light used to perform optical in-situ measurements of a wafer W during planarization. Example wavelengths range anywhere from 190 to 3500 nanometers.

Window 30 is made of any material (e.g., polymers such as polyurethane, acrylic, polycarbonate, nylon, polyester, etc.) that might have roughness 40 on one or more of its surfaces. In an example embodiment of the present invention, roughness 40 is capable of scattering significant amounts (e.g., 10% or more) of the light incident thereon when performing in-situ end-point measurements.

In an example embodiment, roughness 40 arises from an instrument (not shown) used to form the window by cutting it from a larger block of window material. However, roughness 40 can arise from any number of other sources, such as inherent material roughness, not polishing the window material, improperly polishing the window material, etc.

With continuing reference to the Figure, window 30 includes an anti-scattering layer 50 formed over lower surface 34. Layer 50 has an upper surface 52 at the interface of lower surface 34, and a lower surface opposite the upper surface. Anti-scattering layer 50 is formed from any material that is transparent to one or more of the wavelengths of light used to perform in-situ optical measurements of a wafer during planarization. Further, in an example embodiment, layer 50 has an index of refraction that is as close as possible to the index of refraction of window 30. In an example embodiment, window 30 is made of polyurethane having an index of refraction of 1.55 at a wavelength of 670 nanometers, which is a diode laser wavelength. Further in the example embodiment, layer 50 is polyurethane having essentially the same refractive index of 1.55 at 670 nanometers. In another example embodiment, layer 50 is formed from the same material as window 30.

In example embodiments, layer 50 includes a transparent solvent-borne lacquer, such as made from acrylic, polyurethane, polystyrene, polyvinyl chloride (PVC), or other transparent soluble polymers. Another example embodiment, layer 50 includes a radiation-cured coating, such as ultraviolet (UV)-cured acrylic or polyurethane. In another example embodiment, two or more component coatings, such as epoxies, polyurethanes, and/or acrylics are combined. In other example embodiments, single-component air-cured transparent coatings, such as moisture-cured polyurethanes, oxygen-polymerized enamels and like coatings that cure upon exposure to the atmosphere are used in the formation of layer 50. Likewise, in another example embodiment, hot melt coatings can be used, such as hot melt films and powder coatings. In short, any transparent coating that acts to substantially reduce the surface roughness of lower surface 34 is suitable for use as layer 50.

Layer 50 is formed on lower surface 34 by any one of the known techniques suitable to the material being used, such as spray coating, dipping, brushing, melting, etc. It is preferred that layer 50 be conformal to the roughness on lower surface 34 to minimize scattering, yet be thick enough to have a substantially flat lower surface 54. In an example embodiment, lower surface 54 is made flat by polishing. In another example embodiment, lower surface 54 naturally forms a reasonably flat surface by virtue of the technique used to form the layer. For example, melting a section of polyurethane onto the window and letting the melted material flow will fill in the roughness 40 while also flowing out on the opposite surface to form a flat lower surface 54.

It is important to note that lower surface need not be entirely flat. For example, lower surface 54 can have slowly varying surface curvature that does not scatter light, but merely reflects light at slight angle. This is because anti-scattering layer 50 is designed to eliminate light scattering, which is the main cause of signal degradation in optical in-situ monitoring systems.

METHOD OF OPERATION

With continuing reference to the Figure, the operation of the present invention for performing in-situ optical measurements of wafer W having a surface 62 to be measured is now described. In operation, a first light beam 70 is generated by a light source 71 and is directed towards wafer surface 62. First light beam 70 has a wavelength that is transmitted by both window 30 and anti-scattering layer 50.

First light beam 70 reaches wafer surface 62 by passing through anti-scatter layer 50, window lower surface 34, window body portion 31, window upper surface 32, and a gap 66 between the window upper surface and the wafer surface. Gap G is occupied by a slurry 68 (not shown), which in practice acts as an index-matching fluid to reduce the scattering of light from roughness 40 on window upper surface 34. First light beam 70—or more specifically, a portion thereof—reflects from wafer surface 62. Wafer surface 62 is shown schematically herein. In actuality, wafer surface 62 represents surface topography or one or more interfaces present on the wafer due to different films (e.g., oxide coatings).

The reflection of first light beam 70 from wafer surface forms a second light beam 72 that is directed back along the incident direction of first light beam 70. In an example embodiment where wafer surface 62 includes multiple interfaces due to one or more films resided thereon, reflected light beam 72 includes interference information due to multiple reflections.

Upon reflection from wafer surface 62, second light beam 72 traverses gap G (including the slurry residing therein), and passes through window upper surface 34, window body 31, window lower surface 31, and finally through anti-scattering layer 50. It is noteworthy that the reflections from each interface, including those on the wafer are two-fold because of retro-reflection from wafer surface 62. In other words, the light passes twice through each interface with the exception of the actual wafer surface itself. The result is a significant loss of energy relative to the original beam, which translates into a diminished signal strength.

Upon exiting anti-scattering layer 50, light beam 72 is detected by a detector 80. In an example embodiment, a beam splitter (not shown) is used to separate first and second light beams 70 and 72. Detector 80 then converts the detected light to an electrical signal 81, which is then processed by a computer 82 to extract information about the properties of wafer 60, e.g., film thickness, surface planarity, surface flatness, etc.

Because window 30 includes anti-scattering layer 50, light loss due to scattering from roughness 40 on window lower surface 34 is greatly diminished. This results in a signal strength that is greater than otherwise possible. The inventors have conducted experiments on polishing pad windows having rough surfaces of the type described above. The inventors measured signal strength in second light beam 72 with and without the anti-scattering layer 50 and found up to a 3X improvement in the signal strength when the anti-scattering layer 50 of the present invention was employed.

Such improvements in signal strength lead to significant improvements in the insitu optical measurement of wafer surface parameters. In particular, reliability and measurement accuracy are improved. Further, the pad lifetime can be extended because the stronger signals make other sources of signal loss less significant. Stated differently, the reduction in scattering from roughened lower window surface 34 allows the other sources of scattering—such as increased roughness of the window upper surface during polishing, and increasing amounts of debris from the planarization process—to become larger without having to replace the pad or the window.

Various embodiments of the invention have been described and illustrated. However, the description and illustrations are by way of example only. Other embodiments and implementations are possible within the scope of this invention and will be apparent to those of ordinary skill in the art. Therefore, the invention is not limited to the specific details, representative embodiments, and illustrated examples in this description. Accordingly, the invention is not to be restricted except in light as necessitated by the accompanying claims and their equivalents.

What is claimed is:

1. An apparatus comprising:

a polishing pad body having an aperture formed therein;

a window fixed in the aperture, the window having a lower surface with a surface roughness capable of scattering light incident thereon; and an anti-scattering layer formed over the lower surface of the window to reduce the scattering of light by the roughened lower surface.

2. The apparatus of claim 1, wherein the surface roughness is capable of scattering 10% or more of the light incident thereon.

3. The apparatus of claim 1, wherein the anti-scattering layer includes a transparent solvent-borne lacquer.

4. The apparatus of claim 1, wherein the anti-scattering layer includes a radiation-cured transparent material.

5. The apparatus of claim 1, wherein the window is made of a first material and the anti-scattering layer is also made of the first material.

6. A window for a polishing pad for a chemical-mechanical planarization (CMP) system, comprising:

a window body having an upper and lower surface, the lower surface having a surface roughness sufficient to scatter 10% or more of light incident thereon; and an-anti-scattering layer formed over the lower surface of the window to reduce the scattering of light by the roughened lower surface.

7. A method of performing in-situ optical measurements of a wafer in a chemical-mechanical planarization (CMP) system, comprising:

providing the CMP system with a polishing pad having a window, the window having a roughened lower surface upon which is formed an anti-scattering layer;

directing a first beam of light through the anti-scattering layer and the window to the wafer; and reflecting the first beam of light from the wafer to form a second beam of light that passes back through the window and the anti-scattering layer.

8. The method of claim 7, further including:

detecting the second beam of light;

converting the detected second beam of light to an electrical signal; and processing the electrical signal to deduce one or more properties of the wafer.

* * * * *